United States Patent [19]

Mallinson

[11] 4,306,683

[45] Dec. 22, 1981

[54] ELECTROMAGNETIC FUEL INJECTOR WITH ADJUSTABLE ARMATURE SPRING

[75] Inventor: Charles E. Mallinson, Jenison, Mich.

[73] Assignee: General Motors Corporation, Detroit, Mich.

[21] Appl. No.: 170,733

[22] Filed: Jul. 21, 1980

[51] Int. Cl.[3] ..... B05B 1/32

[52] U.S. Cl. ..... 239/585

[58] Field of Search ..... 239/87, 585; 123/472, 123/445, 261; 251/139

[56] References Cited

U.S. PATENT DOCUMENTS

| | | | |
|---|---|---|---|
| 2,980,090 | 4/1961 | Sutton et al. | 123/119 |
| 3,653,630 | 4/1972 | Ritsema | 251/129 |
| 3,662,987 | 5/1972 | Schlagmuller et al. | 251/139 |
| 3,738,578 | 6/1973 | Farrell | 239/585 |
| 4,008,876 | 2/1977 | Bastle | 251/129 |
| 4,156,506 | 5/1979 | Locke et al. | 239/585 |
| 4,186,708 | 2/1980 | Bowler | 123/472 |
| 4,218,021 | 8/1980 | Palma | 239/585 |
| 4,247,044 | 1/1981 | Smith | 239/585 |

*Primary Examiner*—Robert B. Reeves
*Assistant Examiner*—Gene A. Church
*Attorney, Agent, or Firm*—Arthur N. Krein

[57] ABSTRACT

An electromagnetic fuel injector has an axially fixed guide pin for axial alignment of a spring biased, movable armature. The guide pin has an abutment shoulder thereon for engagement with a surface of the armature whereby to serve as an abutment stop so as to establish a predetermined minimum working air gap between the opposed working surfaces of the armature and an associated solenoid pole. A spring seat ring carried by an axially movable adjusting rod slidably received by a portion of the guide pin serves as an abutment for one end of the armature spring. An externally accessible abutment screw is used to effect axial displacement of the adjusting rod and therefor of the spring seat ring whereby to adjust the force of the armature spring.

2 Claims, 4 Drawing Figures

ELECTROMAGNETIC FUEL INJECTOR WITH ADJUSTABLE ARMATURE SPRING

FIELD OF THE INVENTION

This invention relates to electromagnetic fuel injectors and, in particular, to such an injector having means therein to provide a minimum fixed working air gap and externally accessible means for adjusting the load of the armature return spring.

DESCRIPTION OF THE PRIOR ART

Electromagnetic fuel injectors are used in fuel injection systems for vehicle engines because of the capability of this type injector to more effectively control the discharge of a precise metered quantity of fuel per unit of time to an engine. Such electomagnetic fuel injectors, as used in vehicle engines, are normally calibrated so as to inject a predetermined quantity of fuel per unit of time prior to their installation in the fuel system for a particular engine.

In one such type electromagnetic fuel injector which is presently used in a fuel system of the type shown in U.S. Pat. No. 4,186,708 entitled "Fuel Injection Apparatus With Wetting Action" issued FEB. 5, 1980 to Lauren L. Bowler, that is presently used in commercially available passenger vehicles, a two-part valve means movable relative to an annular valve seat is used to open and close a passage for the delivery of fuel from the injector out through an injection nozzle having delivery orifices downstream of the valve seat. One part of this valve means is a sphere-like valve member having a flat on one side thereof and being spherical opposite the flat to provide a spherical seating surface for valve closing engagement with the valve seat. The other part of the valve means is an armature with a flat end face seated against the flat surface of the valve member in a laterally slidable engagement therewith.

In this type injector, the armature is provided with an axial through guide bore to slidably receive a fixed, axially extending guide pin. An armature spring is positioned within the injector to normally bias the armature in a direction to effect seating of the valve member against the valve seat. A fixed minimum working air gap may be provided for in this type injector by the use of a thin shim of non-magnetic material fastened to the pole piece face so as to provide the necessary gap between the armature and the solenoid pole piece when the injector is open. Alternatively, as disclosed in copending U.S. Pat. application Ser. No. 082,893 entitled "Electromagnetic Fuel Injector" filed Oct. 9, 1979 in the name of Leo A. Gray and assigned to a common assignee, a fixed minimum working air gap may be provided for in this type injector by the use of a stepped guide pin provided with a shoulder for abutment against a portion of the armature whereby to limit movement of the armature relative to the solenoid pole piece.

Also in this type injector, the injection nozzle is axially adjustable in the body of the injector whereby the annular valve seat can be moved axially while the injector is flowing calibration fluid on a continuous basis therethrough until the desired flow rate is achieved, thus establishing the stroke length of the armature/-valve for that injector.

Although during such calibration, the flow rate of each injector can be properly calibrated, unfortunately the axial displacement of the injector nozzle during such calibration will cause a corresponding change in the armature spring force, depending on the axial extent of movement of the injector nozzle.

As will be apparent, any change in the armature spring force will effect the dynamic response of the armature upon energization of its associated solenoid and, accordingly, effect the output of the injector.

SUMMARY OF THE INVENTION

Accordingly, a primary object of the present invention is to provide an improved electromagnetic fuel injector construction that advantageously utilizes a shouldered guide pin for axial alignment of a movable armature and to provide an abutment for limiting axial movement of the armature in one direction so as to establish a predetermined minimum working air gap between the opposed surfaces of the armature and the pole piece of its associated solenoid coil, one end of the guide pin being provided with a bore to slidably receive an externally axially adjustable rod carrying a spring seat ring against which one end of the armature spring abuts.

Another object of the invention is to provide an improved solenoid structure for use in an electromagnetic fuel injector of the type having an injector nozzle assembly with a valve seat that can be axially positioned to obtain a desired fuel discharge rate, wherein the solenoid pole is provided with a shouldered guide pin axially fixed thereto to serve as a guide for axial movement of an armature and as a stop to limit movement of the armature in one axial direction towards the solenoid pole, the guide pin having an axial bore and an intersecting radial aperture therein to receive a spring adjusting means including a spring abutment ring against which one end of an armature biasing spring abuts whereby the force of the spring can be externally adjusted.

Still another object of the present invention is to provide an electromagnetic fuel injector of the above type which includes features of solenoid construction, operation and arrangement, rendering it easy and inexpensive to manufacture and to calibrate both for the desired fuel flow and for dynamic response, which is reliable in operation, and in other respects suitable for extended use on production motor vehicle fuel systems.

The present invention relates to an electromagnetic fuel injector of the type having an axially adjustable nozzle assembly therein. This nozzle assembly provides an annular valve seat cooperating with a movable valve member defined by a spherical valve element having a flat face on one side thereof which is seated on the flat end face of an armature but which can slide sideways to accommodate misalignment. The armature is biased by an armature return spring towards a valve closed position and is drawn towards the pole piece against the bias of this spring by current flow in the solenoid coil. The armature is guided by a small diameter guide pin for axial movement, the guide pin being axially fixed in a solenoid pole piece. The armature, under the spring bias, locates the valve element in a closed, centered position on the valve seat. The guide pin is provided with a shoulder to provide a stop for the armature in the direction of its travel toward its associated solenoid pole piece so as to provide a minimum air gap between the opposed working surfaces of the solenoid pole piece and armature. The guide pin, in accordance with the invention, is also provided with an axial bore that intersects a radial extending aperture whereby to support an adjusting rod carrying a spring seat ring against which one end of the armature spring abuts. The injector is also provided with an externally accessible driver-receiving screw which abuts one end of the adjusting rod whereby to effect the desired axial displacement of the spring seat nut so as to vary the armature spring load, as desired, for the desired dynamic response of the armature upon energization of the solenoid coil.

For a better understanding of the invention, as well as other objects and further features thereof, reference is had to the following detailed description of the invention to be read in connection with the accompanying drawings.

DESCRIPTION OF A PREFERRED EMBODIMENT

Figure 1:
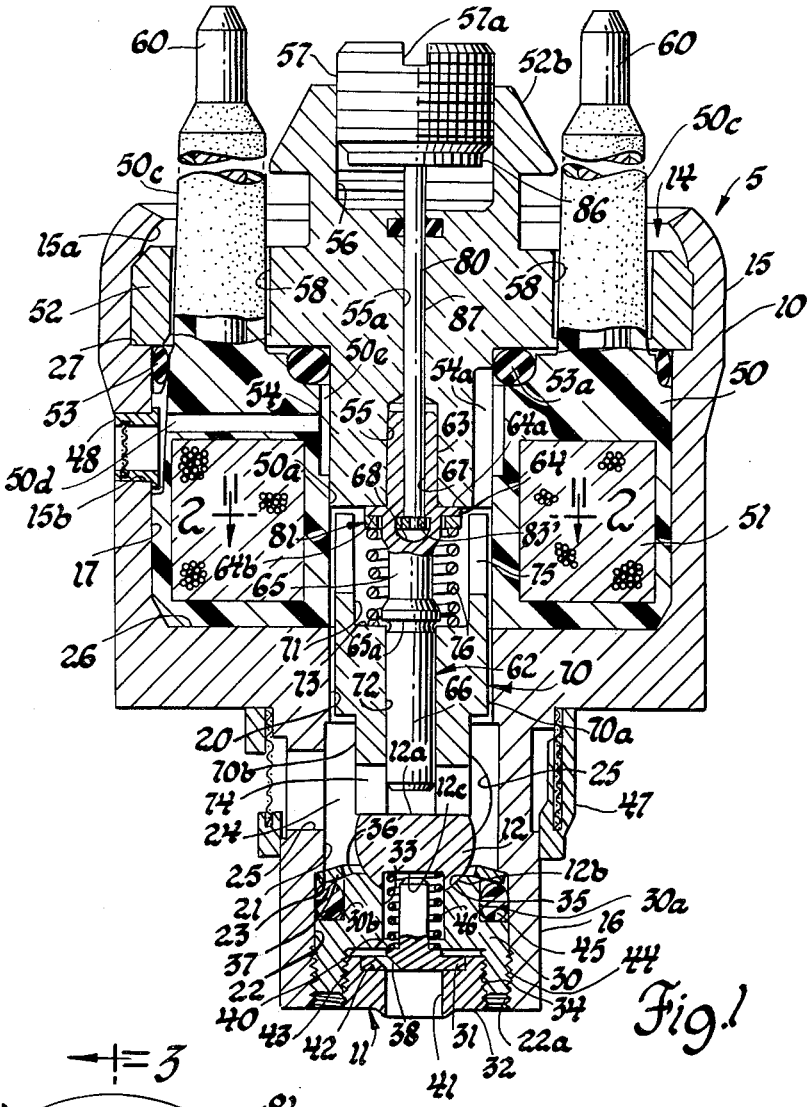
FIG. 1 is an enlarged longitudinal, cross-sectional view of an exemplary embodiment of an electromagnetic fuel injector having a solenoid structure in accordance with the invention incorporated therein, the lower portion of the armature guide pin and the armature spring adjusting means of the assembly being shown in elevation.

Referring now to FIG. 1, an electromagnetic fuel injector, generally designated 5, constructed in accordance with a preferred embodiment of the invention, includes a body 10, a nozzle assembly 11, a valve member 12 and a solenoid assembly 14 as major components thereof.

In the construction illustrated, the body 10, made, for example, of a suitable iron or steel, is of circular hollow tubular configuration and is of such external shape so as to permit direct insertion, if desired, of the injector into a socket provided for this purpose in either an intake maifold, not shown, or in an injector mechanism of a throttle body injection apparatus, not shown, for an engine.

The body 10, includes an enlarged upper solenoid case portion 15 and a lower end nozzle case portion 16 of reduced external diameter relative to portion 15. An internal cylindrical cavity 17 is formed in the body 10 by a stepped vertical bore therethrough that is substantially co-axial with the axis of the body. In the construction shown, the stepped bore in body 10 provides internal, cylindrical upper and lower intermediate walls 20 and 21, respectively, and a cylindrical lower wall 22. Wall 20 is of an internal diameter so as to loosely slidably receive the large diameter end of an armature 70, to be described, while wall 21 is of greater diameter than wall 20 but of smaller diameter than lower wall 22. Walls 21 and 22, in the embodiment illustrated, are interconnected by a shoulder 23.

Lower intermediate wall 21 defines the outer peripheral extent of a fuel chamber 24 within the body 10. In addition, the body 10 is provided with a plurality of circumferentially equally spaced apart, radial port passages 25 in the nozzle case portion 16 thereof which open through the wall 21 to effect flow communication with the fuel chamber 24. Preferably three such passages are used in the preferred embodiment of the injector illustrated.

The injection nozzle assembly 11 mounted in the lower nozzle case portion 16 of body 10 includes, in succession starting from the upper end with reference to FIG. 1, a seat element 30, a swirl director plate 31 and a spray tip 32. The spray tip 32 supports the director plate 31 within the seat element 30 and these elements are positioned in the lower cavity formed by the cylindrical wall 22 in the lower nozzle case portion 16 in a manner to be described.

In the embodiment shown, the seat element 30 is provided with a stepped bore therethrough to define a central axial discharge passage 33 at its upper end and a lower enlarged diameter internally threaded portion 34 at its lower end. As shown, passage 33 is tapered outward at its lower end next adjacent to the portion 34. The seat element 30 is also provided with an annular, conical valve seat 35 on its upper surface 36, the valve seat being formed concentric with and encircling the upper end of the discharge passage 33. The upper surface 36 of the seat element 30, in the embodiment illustrated, is downwardly tapered adjacent to its outer peripheral edge, with this tapered portion being formed at a suitable angle from the horizontal so as to provide an abutment shoulder for the outer peripheral annular edge on one side of an abutment washer 37, for a purpose to be described.

The swirl director plate 31 is provided with a plurality of circumferentially, equally spaced apart, inclined and axially extending director passages 38. Preferably, six such passages are used, although only one such passage is shown in FIG. 1. These director passages 38, of predetermined equal diameters, extend at one end downward from the upper surface of the swirl director plate 31 and are positioned so as to encircle a boss 40 formed integral with the director plate 31 to extend vertically upward from the upper surface of the main body portion thereof. The boss 40 thus extends vertically upward loosely into the discharge passage 33 so as to terminate at a predetermined location, a location that is axially spaced from the lower end of the valve member 12 when this valve is in its seated position shown.

The spray tip 32 is provided with a straight through passage 41 which serves as a combined swirl chamber-discharge passage for the discharge of fuel from this nozzle assembly. As shown the spray tip 32 is provided at its upper end with a recessed circular groove 42 of a size so as to receive the main body portion of the swirl director plate 31 therein whereby to locate this element substantially co-axial with the axis of the swirl chamber-discharge passage 41.

In the construction shown, the outer peripheral surface of the spray tip 32 is provided with external threads 43 for mating engagement with the internal threaded portion 34 of seat element 30.

In addition, the outer peripheral lower portion of the seat element 30 is provided with external threads 44 for mating engagement with the internal threads **22*a* of the lower wall in the nozzle portion 16 of body 10. Preferably the threads 22*a* and 44 and threads 44 and 43 are of suitable fine pitch whereby to limit axial movement of the seat element or spray tip, a predetermined extent as desired, for each full revolution of the seat element and spray tip relative to the seat element and body 10**, respectively.

The lower face of the seat element 30 and spray tip 32 are each provided, for example, with at least a pair of diametrically opposed blind bores, not shown, of a size so as to slidably receive the lugs of suitable spanner wrenches, not shown, whereby rotational torque may be applied to the seat element 30 or spray tip 32 during assembly and axial adjustment of this element in the body 10.

With the structural arrangement shown, the stroke of the injector can be accurately adjusted by the use of a collapsible abutment member between the upper surface of the valve seat element 30 and the shoulder 23 of the body 10. The collapsible abutment member, in the construction shown, is in the form of a flat spring abutment washer 37 of a suitable outside diameter to be slidably received within the lower wall 22 so as to abut against shoulder 23 located a predetermined axial distance from the lower flat end of the pole piece 52 of the solenoid assembly 14, to be described hereinafter. The abutment washer 37 when first installed would be flat. As thus assembled, the upper outer peripheral edge of the washer 37 would engage against the outer radial portion of the shoulder 23 and its radial inner edge on the opposite side thereof would abut against the upper tapered surface 36 of the seat element 30. With the washer 37, seat element 30, swirl director plate 31, and the spray tip 32 thus assembled and with the spray tip 32 in threaded engagement with internal threads 22*a*, these elements can then be axially adjustably positioned upward within the lower end of the body 10.

After these elements are thus assembled, actual adjustment of the injector stroke is made while the injector is flowing calibration fluid on a continuous basis therethrough. During flow of the calibration fluid, an operator, through the use of a spanner wrench, not shown, can rotate the seat element 30 in a direction whereby to effect axial displacement thereof in an upward direction with reference to FIG. 1. As the nozzle assembly is moved axially upward by rotation of the seat element 30, it will cause the abutment washer 37 to deflect or bend into a truncated cone shape, as shown in FIG. 1, to thereby in effect forcibly move the lower abutment surface of the washer 37 upward relative to the fixed shoulder 23 until the desired flow rate is achieved. This thus establishes the correct axial position of the valve seat 35 on seat element 30 for the proper stroke length of the armature/valve for that injector. The seat element 30 is then secured against rotation relative to the body 10 by any suitable means such as, for example, by laser beam welding at the threaded interface of these elements.

With the above described arrangement, the effective flow orifice of the valve and valve seat interface, as generated by length of injector stroke, is controlled directly within very close tolerances by an actual flow measurement rather than by a mechanical displacement gauge measurement.

An O-ring seal 45 is operatively positioned to effect a seal between the seat element 30 and the wall 22. In the construction shown in FIG. 1, the seat element 30 is provided with an external reduced diameter wall 30*a* at its upper end to receive the O-ring seal 45. The ring seal 45 is retained axially in one direction by the flat shoulder 30*b* of the seat element 30 and in the opposite direction by its abutment against the lower surface of washer 37.

Flow through the discharge passage 33 in seat element 30 is controlled by the valve 12 which is loosely received within the fuel chamber 24. This valve member is movable vertically between a closed position at which it is seated against the valve seat 35 and an open position at which it is unseated, from the valve seat 35, as described in greater detail hereinafter. In the construction illustrated, the valve 12 is of a truncated ball-like configuration to provide a semi-spherical seating surface for engagement against the valve seat 35. As shown in FIG. 1, the valve 12 is made in the form of a ball which is truncated at one end whereby to provide a flat surface 12*a* on its upper side for a purpose to be described, the lower seating surface portion 12*b* thereof being a semi-spherical configuration whereby to be self-centering when engaging the conical valve seat 35.

In the construction shown, a valve spring 46, of predetermined force is used to aid in unseating of the valve 12 from the valve seat 35 and to hold this valve in abutment against the lower end of its associated armature 70 when in its open position during periods of injection. As shown, the compression valve spring 46 is positioned on the lower side of the valve 12 so as to be loosely received in the discharge passage 33 of seat element 30. The valve spring 46 is thus positioned to abut at one end, its lower end with reference to FIG. 1, against the upper surface of director plate 31 and to abut at its opposite end against a flat surface 12*c* provided by a blind bore in the lower semi-spherical portion of valve 12 opposite the flat surface 12*a*. Normal seating and actuation of the valve 12 is controlled by the armature 70 of solenoid assembly 14, in a manner to be described.

To effect filtering of the fuel being supplied to the injector 5 prior to its entry into the fuel chamber 24, there is provided a fuel filter assembly, generally designated 47. The fuel filter assembly 47 is adapted to be suitably secured, as for example by predetermined press fit, to the body 10 in position to encircle the radial port passages 25 therethrough.

The solenoid assembly 14 of the injector 5 includes a tubular coil bobbin 50 supporting a wound wire solenoid coil 51 and having an axial bore aperture 50*a* extending therethrough. Bobbin 50 is positioned in the body 10 between an internal flat shoulder 26 thereof and the lower surface of a circular pole piece 52 that is slidably received at its outer peripheral edge within an enlarged upper wall portion of body 10. Pole piece 52 is axially retained within body 10, as by being sandwiched between an internal flat shoulder 27 and the radially inward spun over upper rim 15*a* of the body. Annular seals 53 and 53*a* are used to effect a seal between the body 10 and the upper, outer peripheral end of bobbin 50 and between the upper end of bobbin 50 and the lower surface of pole piece 52, respectively.

A fuel filter plug assembly 48 suitably secured in a radial port 15*b* provided in the solenoid case portion 15*b* of body 10 is used for the return of fuel flowing from fuel chamber 24 upward into and around bobbin 50. A radial passage 50*d* in bobbin 50 interconnects the enlarged diameter portion of bore 50*a* with axial groove 50*e* in bobbin 50. In addition, as shown, pole 54 is provided with an axial extending passage in the form of slot 54*a* on its outer peripheral surface to effect hydraulic pressure relief during movement of the armature 70, to be described, toward the free end of pole 54.

Formed integral with the pole piece 52 and extending centrally downward therefrom is a tubular pole 54. Pole 54 is of a suitable external diameter so as to be slidably received in the bore aperture 50*a* of bobbin 50. The pole 54, as formed integral with the pole piece 52, is of a predetermined axial extent so as to extend a predetermined axial distance into the bobbin 50 in axial spaced apart relation to the shoulder 27. The pole piece 52, in the construction illustrated, is also provided with an upstanding central boss 52*b* that is radially enlarged at its upper end for a purpose which will become apparent.

Pole piece 52 and its integral pole 54 are formed with a central through stepped bore to define an internal cylindrical lower wall 55, an intermediate wall 55*a* of reduced diameter relative to wall 55 and an upper enlarged diameter internally threaded wall 56 located within the enlarged portion of boss 52*b*. An abutment stop, in the form of an adjustable abutment screw 57, having a tool receiving slot 57*a* extending therethrough for a purpose to be described hereinafter, is adjustably threadedly received by the thread 56.

Pole piece 52 is also provided with a pair of diametrically opposed circular through circular slots 58 located radially outward of boss 52*b* so as to receive the upright circular studs 50*c* of bobbin 50. Each such stud 50*c* has one end of a terminal lead 60 extending axially therethrough for connection to a suitable controlled source of electrical power, as desired. The opposite end, not shown, of each such lead 60 is connected (not shown), as by solder, to a terminal end of coil 51.

To effect axial guided movement of the armature 70, to be described, there is provided an armature guide pin 62 having one end thereof fixed to the pole 54 portion of pole piece 52. For this purpose, the guide pin 62 in the embodiment shown, made of a suitable non-magnetic material and of circular configuration, includes, starting from the top, a straight upper land portion 63, an enlarged diameter flange 64, an intermediate portion 65 and a lower free end guide stem 66. The land portion 63 is of a suitable outside diameter to provide for a press fit within the internal lower wall 55 of the pole 54 of pole piece 52.

The intermediate portion 65 is of a suitable reduced diameter relative to the diameter of flange 64 but of larger diameter than guide stem 66 whereby to provide a flat abutment shoulder 65*a* at its lower end, with reference to FIG. 1, that extends radially outward from guide stem 66. With this structure, the flange 64 provides opposed upper and lower radial flat surfaces 64*a* and 64*b*, respectively, the surface 64*a* thus being adapted to serve as a stop for abutment against the lower end surface of pole 54.

As part of the subject invention, the guide pin 62 is provided with a blind bore 67, of a diameter corresponding to the inside diameter of intermediate wall 55*a* of pole piece 52, that extends axially down through both the land portion 63 and flange 64 thereof into the intermediate portion 65 for a predetermined axial distance and, in addition, a radial through slot 68 is formed in the intermediate portion so as to intersect bore 67, all for a purpose to be described hereinafter. As shown in FIG. 1, slot 68 extends downward from the lower surface 64*b* of flange 64 for a suitable axial distance corresponding to the depth of bore 67 into the intermediate portion 65.

The armature 70 of the solenoid assembly 14 is of a cylindrical tubular construction with an upper portion 70*a* and a lower reduced diameter portion 70*b*. Upper portion 70*a* is of a suitable outside diameter whereby this armature is loosely and slidably received within the intermediate wall 20 of body 10 and in the lower portion of bore aperture 50*a* in bobbin 50. The armature 70 is formed with a stepped central bore therethrough to provide an upper spring cavity portion defined by an internal cylindrical upper wall 71 of a suitable predetermined inside diameter and a lower cylindrical pin guide bore wall 72 portion of a preselected smaller inside diameter than that of wall 71 and of a size whereby to slidably receive the small diameter guide stem 66 of the armature guide pin 62. As previously described, the armature 70 is axially guided for movement relative to pole 54 by the guide stem 66 of armature guide pin 62. As shown, the wall 71 and the guide bore wall 72 of the armature 70 are interconnected by a flat shoulder 73 for a purpose which will become apparent.

The armature 70 at its lower end is provided with a central radial extending through narrow slot 74 formed at right angles to the axis of the armature. At its opposite or upper end, the armature 70 is also provided with at least one right angle, through narrow slot 75 to effect hydraulic pressure relief during movement of the armature toward the associated end of pole 54.

As shown in FIG. 1, the armature 70 is slidably positioned for vertical axial movement as guided by the guide stem 66 of armature guide pin 62 between a lowered position, as shown, at which it abuts against the upper flat surface 12*a* of valve 12 to force the valve into seating engagement with the valve seat 35 and a raised position at which the internal flat wall 73 of the armature 70 abuts against the shoulder 65*a* of the guide pin 62.

When the armature 70 is in its lowered position, the position shown in FIG. 1, a working air gap is established between the lower end of the pole 54 and the upper end of the armature 70 by axial positioning of the nozzle assembly 11 in the manner described hereinabove. The axial extent of the abutment shoulder 65*a* from surface 64*a* on guide pin 62 is preselected so as to be slightly greater than the axial distance between the upper end surface of armature 70 and its shoulder 73, as desired, whereby a minimum fixed working air gap will exist between the upper end surface of armature 70 and the lower end surface of pole 54 when the armature 70 is moved upward, from the position shown in FIG. 1, so that its shoulder 73 abuts against the abutment shoulder 65*a* of guide pin 62.

Armature 70 is normally biased to its lowered position, as shown, with the valve 12 seated against the valve seat 35 by means of a coiled armature return spring 76 which is of a predetermined force value greater than that of the valve spring 46. Spring 76 is positioned in the spring cavity within the armature 70 so as to loosely encircle the intermediate portion 65 of guide pin 62 with one end of the spring thus positioned to abut against the surface provided by radial shoulder 73 at the bottom of the spring cavity in armature 70.

Now in accordance with the invention, a spring abutment means, including an adjusting rod 80 and a spring seat ring 81, is incorporated into the solenoid assembly whereby to provide an axially adjustable annular abutment surface that is operatively positioned so as to serve as an abutment stop for the opposite end of the armature spring 76.

Figure 2:
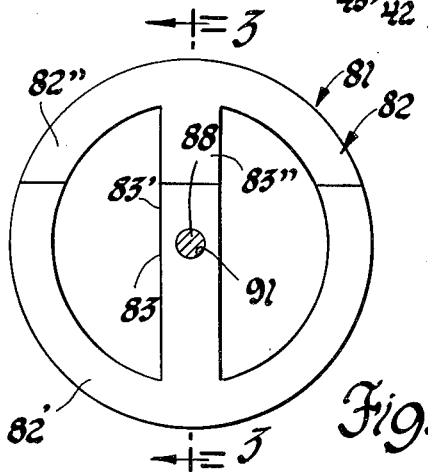
FIG. 2 is an enlarged view taken along line 2—3 of FIG. 1 to shown the details of the armature spring seat ring and rod of the assembly.
Figure 3:
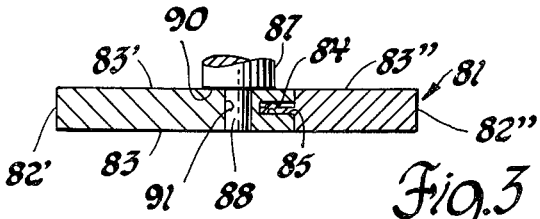
FIG. 3 is a cross-sectional view of the armature spring seat ring and lower portion of its associated rod taken along line 3—3 of FIG. 2; and, FIG. 4 is an exploded perspective view of the armature spring seat ring, per se, of the electromagnetic fuel injector assembly of FIG. 1.
Figure 4:
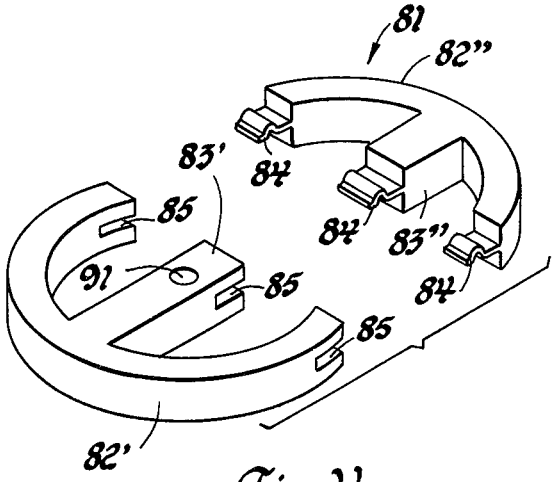

Referring first to the spring seat ring 81, in the embodiment illustrated and as best seen in FIG. 3, it includes an annular ring 82 with a cross-spoke 83. Preferably for ease of assembly to the embodiment of the guide pin 62 illustrated, the spring seat ring is formed of two un-equal E shaped segments suitably held together, as by means of a tongue and groove interconnection. Thus as best seen in FIGS. 2, 3 and 4, one of the segments includes a semicircular rim 82' portion and a spoke 83' portion and the other includes a semi-circular rim 82'' portion and a spoke 83'' portion and these segments are held together by means of the outward extending return bent tabs 84 on the free ends of rim and spoke portions 82'' and 83'', respectively, frictionally engaged in the grooves 85 in the free ends of rim portion 82' and the free end of spoke 83' portion.

The inside diameter of ring 82 is made suitably larger than at least the upper end portion of the intermediate body 65 of guide pin 62 whereby this ring can loosely encircle it so that the ring will provide an abutment for the upper end of the armature spring 76. The width of the cross-spoke 83 is suitably less than the width of slot 68 in the guide pin 62 whereby this cross-spoke is free for axial movement relative to the axis of the guide pin and this cross-spoke is provided with an aperture 91 formed concentric with rim 82.

Adjusting rod 80 includes an enlarged head 86 with a rod 87 depending therefrom that is of a suitable outside diameter to be slidably received in bore 55*a* of pole piece 52 and in bore 67 in the guide pin 62. At its lower free end rod 87 is provided with a reduced diameter portion 88 received in aperture 91 of the spring abutment ring 81. Rod 87 and the portion 88 are interconnected by a flat shoulder 90 against which the cross-spoke 83 of the spring seat ring abuts as biased upward thereagainst by the armature spring 76.

As shown in FIG. 1, the head 86 of adjusting rod 80 is loosely received in the internally threaded wall 56 portion of the pole piece 52 whereby its upper surface will abut against the lower surface of the abutment screw 57. As will now be apparent, the adjusting rod 80 is normally biased in an axial direction toward the abutment screw 57 by the force of the armature spring 76 acting against the spring seat ring 81 and that the axial extent of rod 87 is such as to permit downward movement of the head 86, from its position shown, to permit downward movement of the spring seat ring 81, from its position shown in FIG. 1, whereby to vary the force of the armature spring 76 as desired.

The above-described structural arrangements allows the minimum air gap to be established by means of the shouldered guide pin 62 as previously described hereinabove and allows the stroke of the armature 70 to be adjusted by axial movement of the nozzle assembly 11 so as to obtain the desired discharge flow rate, as desired, in the manner described hereinabove.

After these parameters have been established the armature spring 76 load can then be adjusted to obtain a desired dynamic response by rotating the abutment screw 57 through the use of a suitable tool, such as a screwdriver engaging the screwdriver slot 57*a* in the top thereof.

When the abutment screw 57 is thus manually rotated to effect, for example, downward movement thereof with reference to FIG. 1, the adjusting rod 80 and the associated spring seat ring 81 will be displaced axially downward thus changing the effective load applied by the spring 76 against the associated armature 70. This allows the dynamic response and therefore the dynamic flow output of the injector to be adjusted as desired for a particular application.

Since only the adjusting rod 80 and the spring seat ring 81 move up or down depending on the movement of the abutment screw 57 within predetermined limits, and, since the guide pin 62 is fixed axially by the force of spring 76 effecting the abutment of its flange 64 against the bottom of the pole 54 of pole piece 52, the original fixed air gap dimension is not disturbed. Accordingly, in accordance with the invention, there is provided a structural arrangement which allows the armature spring load to be adjusted independently of the fixed air gap dimension.

While the invention has been described with reference to a particular embodiment disclosed herein, it is not confined to the details set forth since it is apparent that various modifications can be made by those skilled in the art without departing from the scope of the invention.

Accordingly, this application is therefore intended to cover such modifications or changes as may come within the purposes of the invention as defined by the following claims.

The embodiments of the invention in which an exclusive property or privilege is claimed are defined as follows:

1. An electromagnetic fuel injection valve having a housing defining a cylindrical bore within which a solenoid pole with a stepped bore therethrough is axially fixed and within which an armature is translated in opening and closing directions to open and close a fuel passage, an apertured guide pin axially fixed at one end in one end of said stepped bore of said solenoid pole and telescopically received at its opposite end in said armature, said apertured guide pin having a shoulder engageable with the armature to fix the extent of armature movement in said opening direction, a spring in said bore effective at one end to bias said armature in said closing direction, adjustable stop element means seating against the other end of said spring, said stop element means including a spring seat ring having an annular face in engagement with the opposite end of said spring, and an adjusting rod slidably received in said stepped bore and having one end thereof operatively connected to said spring seat ring and, an externally accessible abutment screw threadedly received in the opposite end of said stepped bore of said solenoid pole to abut against the opposite end of said adjusting rod.

2. An electromagnetic fuel injection valve having a housing defining a cylindrical bore within which at one end thereof a solenoid pole is axially fixed and within which at the opposite end thereof an injection nozzle assembly having a fuel passage means therethrough is axially adjustably positioned, an armature being positioned in said bore between said solenoid pole and said injection nozzle assembly for translation in opening and closing directions to open and close said fuel passage means, a stepped axial through bore in said solenoid pole defining in succession from one end thereof an enlarged internally threaded wall, a rod guide bore wall of reduced diameter relative to said internally threaded wall and an enlarged guide pin receiving bore wall, an apertured guide pin axially fixed at one end in one end of said guide pin receiving bore wall of said solenoid pole, and telescopically received at its opposite end in said armature, said apertured guide pin having a shoulder axially spaced a predetermined distance from said solenoid pole for engagement with the armature to fix the extent of armature movement in said opening direction, a spring operatively positioned to encircle a portion of said guide pin in position to be effective at one end thereof to bias said armature in said closing direction, adjustable stop element means seating against the other end of said spring, said stop element means including a spring seat ring having an annular face loosely encircling said guide pin for engagement with the opposite end of said spring, an adjusting rod slidably received in said stepped axial through bore and having one end thereof operatively connected to said spring seat ring and, an abutment screw threadedly received in said internally threaded bore wall to abut against the opposite end of said adjusting rod for effecting axial positioning of said adjusting rod and therefore of said spring seat ring whereby to regulate the force of said spring, said abutment screw having an externally accessible drive means for effecting axial positioning of said abutment screw in said solenoid pole.

* * * * *